US007389723B1

(12) United States Patent
Bullington

(10) Patent No.: US 7,389,723 B1
(45) Date of Patent: Jun. 24, 2008

(54) STRAP JOINT ROTATOR

(75) Inventor: Robert E. Bullington, Milford, DE (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/782,120

(22) Filed: Jul. 24, 2007

(51) Int. Cl.
*B65B 13/02* (2006.01)

(52) U.S. Cl. ..... 100/3; 100/26; 100/33 R

(58) Field of Classification Search ..... 100/3, 100/8, 26, 29, 30, 33 R, 33 PB; 53/589
See application file for complete search history.

(56) References Cited

U.S. PATENT DOCUMENTS 3,720,158 A * 3/1973 Sauer et al. ..... 100/4
7,127,986 B2 * 10/2006 Daniel et al. ..... 100/26

* cited by examiner

*Primary Examiner*—Jimmy T. Nguyen
(74) *Attorney, Agent, or Firm*—Mark W. Croll; Donald J. Breh; Levenfeld Pearlstein, LLC

(57) ABSTRACT

A strap joint rotator is for use in a strapping machine of the type for feeding a strapping material around a load, positioning, tensioning and sealing the strapping material around the load. The strap joint rotator includes a driven wheel having an axis of rotation generally perpendicular to the sealed strap loop, a first drive operably connected to the driven wheel for rotating the driven wheel and a pinch wheel having an axis of rotation parallel to and spaced from the driven wheel. The driven wheel and pinch wheel are moveable toward one another and engageable with one another and moveable away from and disengaged from one another. A second drive is operably connected to the driven wheel and the pinch wheel for moving the driven wheel and pinch wheel parallel to their axes of rotation into the strap loop plane and out of the strap loop plane. The driven wheel and pinch wheel are moved into the strap loop plane and the driven wheel and pinch wheel are engaged with one another to pinch the strap therebetween. The driven wheel is actuated to rotate the strap loop around the load.

16 Claims, 5 Drawing Sheets

STRAP JOINT ROTATOR

BACKGROUND OF THE INVENTION

The present invention is directed to a strap joint rotator. More particularly, the present invention is directed to a strap joint rotator used with a strapping machine for compressible materials.

Strapping machines are well known in the art for securing straps around loads. In one configuration a strapping machine is used to strap compressible loads such as baled cotton or other textile materials. Often, the bales are large, so, in a typical arrangement, multiple straps are fed, tensioned and sealed around the load to create the baled load. Typically, such bales are strapped with plastic strap material.

The strapping machine that is used to create the bale includes several separate but interdependent feed and strapping heads, strap chutes and other components for positioning the multiple straps around the load. Each strapping unit operates in conjunction with each other unit so that the strapping occurs simultaneously at each of the several units. In this manner, the strapping operation is carried out in an efficient and time effective operational mode.

A typical baling and strapping machine is a side seal machine, that is, the seal is made at a strap section along a side of the chute (as opposed to at a section of the strap at the bottom or top of the chute). Because the material has to be compressed to effectively strap the load, the sides (or front and rear) and bottom portions of the strap chute are relatively conventional, but the top portion of the chute is within a movable platen that contacts and compresses the load. The strap chute sections are formed within the platen.

When the compression plate or platen is released, the material expands to "fill" the loop created by the sealed strap. As such, the expanding material creates a stress (a strain) in the strap. This is particularly so in that the direction of expansion of the load is in the direction of the strap at the seal. This results in higher stresses at the seal.

Moreover, the side of the bale is often that portion of the bale that is the "bottom" of the load for purposes of shipping, handling and storage. As such, given that the seal is along the side, the seal may be at that portion of the strap that is in contact with the ground or other object and can possibly be damaged.

Accordingly, there is a need for a device to reposition a strap on a load. Desirably, such a device repositions the strap to relocate the seal relative to the load. More desirably, such a device repositions the strap without twisting or otherwise adversely affecting the load.

BRIEF SUMMARY OF THE INVENTION

A strap joint rotating assembly is for use with a strapping machine of the type for feeding a strapping material around a load, positioning, tensioning and sealing the strapping material to itself to form a joint, around the load. The sealed strap defines a strap loop that defines a strap loop plane. The strap joint rotator repositions a strap on a load to relocate the seal (or joint) relative to the load.

The strap joint rotator includes a driven wheel having an axis of rotation generally perpendicular to the sealed strap loop, a first drive operably connected to the driven wheel for rotating the driven wheel and a pinch wheel having an axis of rotation parallel to and spaced from the driven wheel. The driven wheel and pinch wheel are moveable toward one another and engageable with one another and moveable away from and disengageable from one another.

A second drive is operably connected to the driven wheel and the pinch wheel for moving the driven wheel and pinch wheel parallel to their axes of rotation into the strap loop plane and out of the strap loop plane. The driven wheel and pinch wheel are moved into the strap loop plane and the driven wheel and pinch wheel are engaged with one another to pinch the strap therebetween. The driven wheel is actuated to rotate the strap loop around the load.

In a present embodiment, the driven wheel is mounted to a post and the pinch wheel is mounted to an arm that is pivotally mounted to the post such that the arm pivots toward and away from the post. A cylinder is operably connected to the pinch wheel to pivot pinch wheel arm toward and away from the post. The driven wheel includes an outwardly extending flange at an edge of the driven wheel.

In a present embodiment, the rotating assembly includes a carriage, and a plurality of assemblies are mounted to the carriage. In this configuration, the first drive is operably connected to a common drive element to drive each of the driven wheels. The second drive is operably connected to the carriage to move the carriage to move each rotator assembly, as one unit, into and out of their respective strap loop planes.

A strapping machine having multiple strapping units with the strap joint rotator is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

It should be further understood that the title of this section of the specification, namely, "Detailed Description Of The Invention", relates to a requirement of the United States Patent Office, and does not imply, nor should be inferred to limit the subject matter disclosed herein.

Figure 1A:
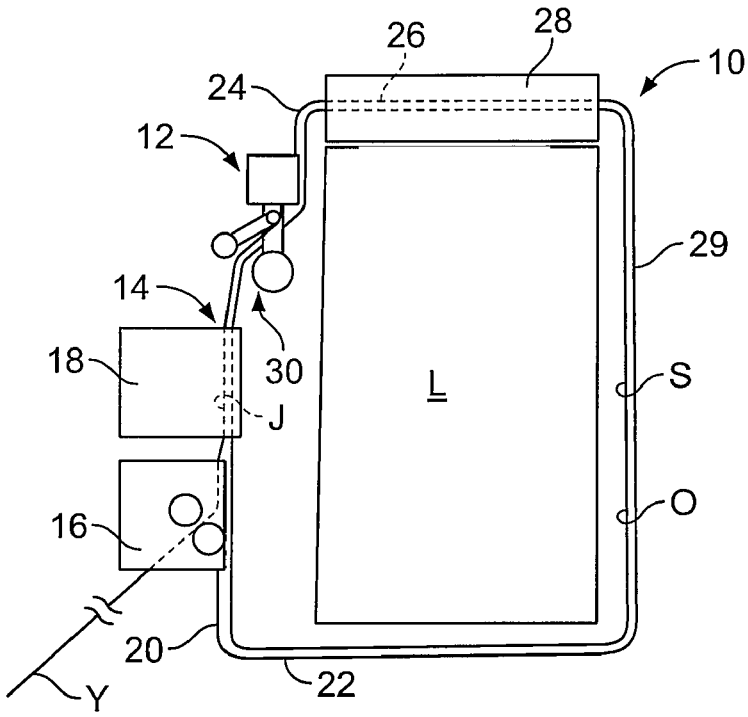
FIG. 1A is a schematic illustration of a strapping machine having a strap joint rotator embodying the principles of the present invention.
Figure 1B:
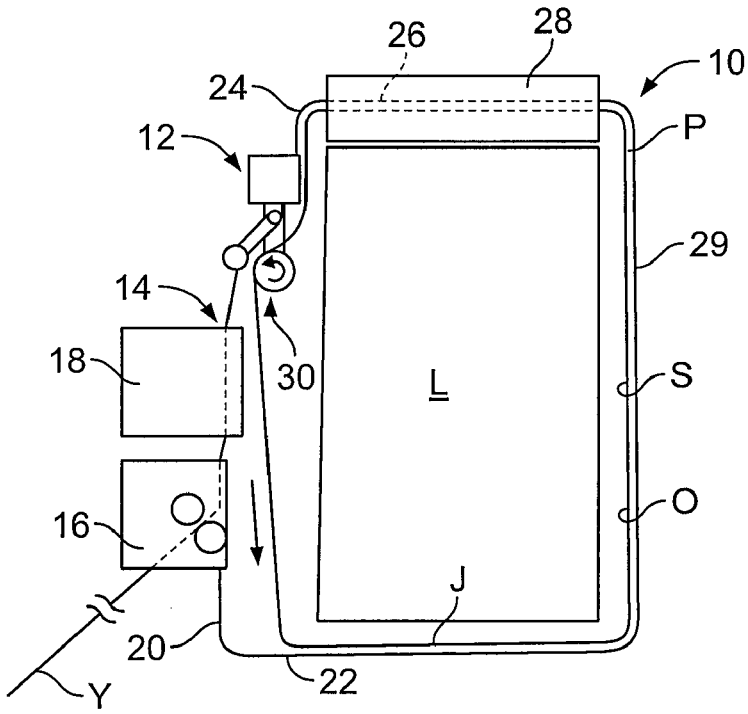
FIG. 1B is a schematic illustration similar to FIG. 1A with the strap engaged by the rotator an being rotated to a different position on the load.
Figure 2:
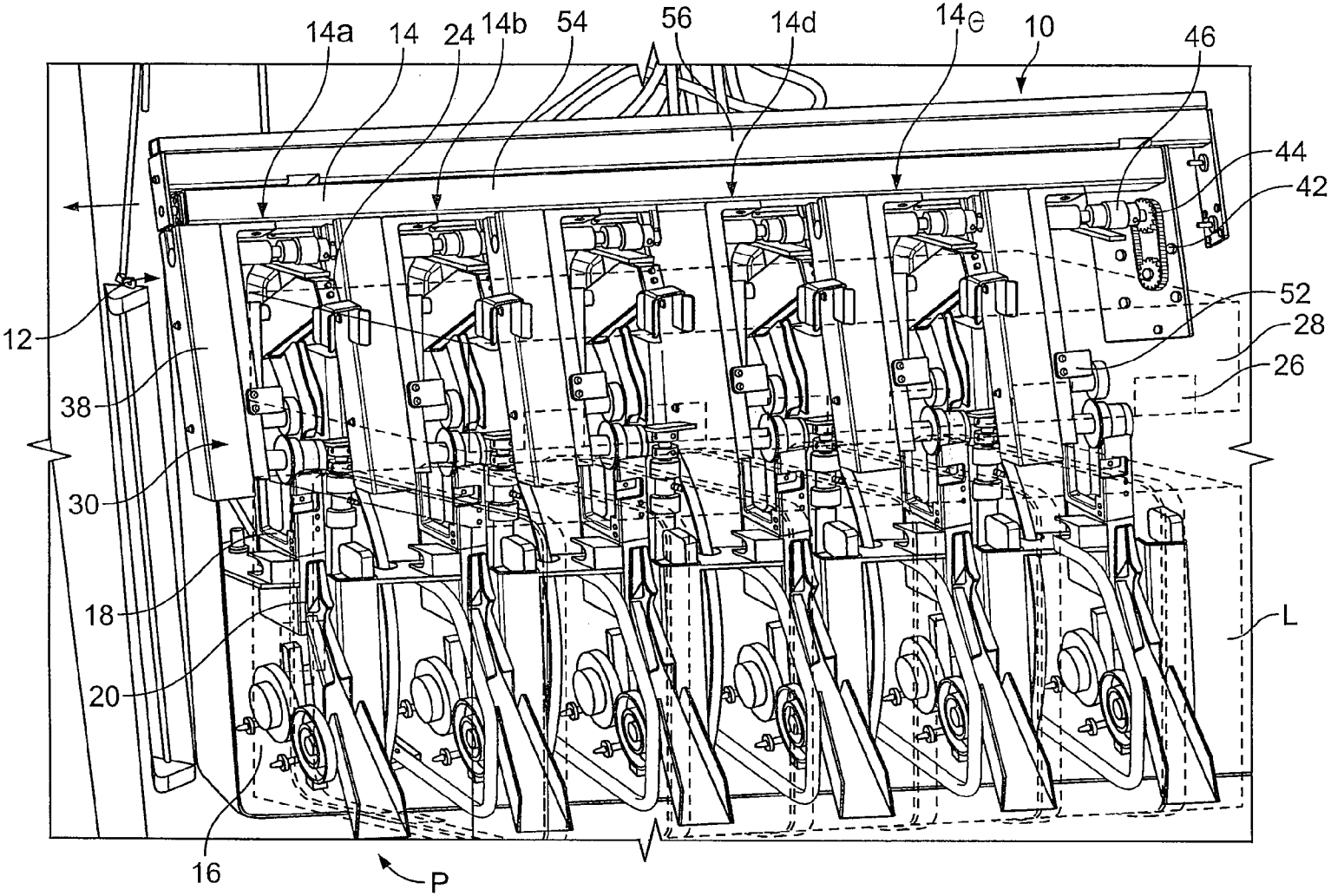
FIG. 2 is a front view of the machine showing the strapping head, feed heads and the rotator, and showing the upper platen and load in phantom lines.
Figure 3:
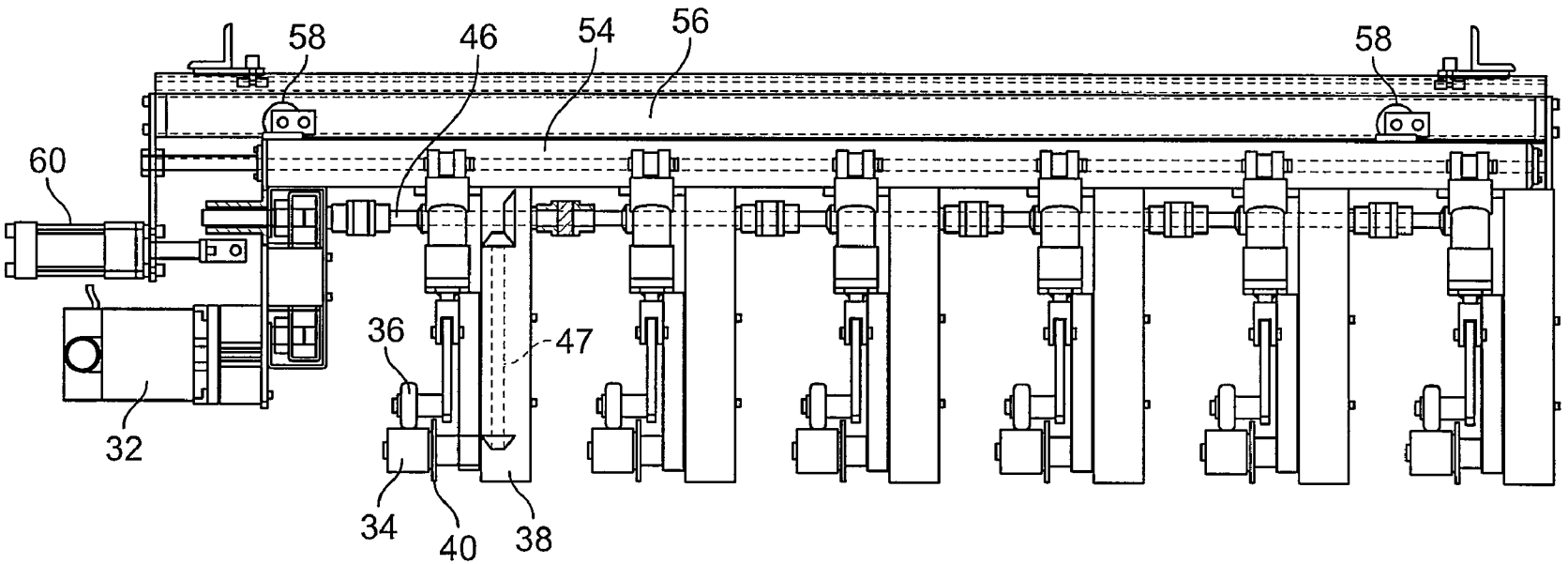
FIG. 3 is a rear view of the strap rotator.
Figure 4:
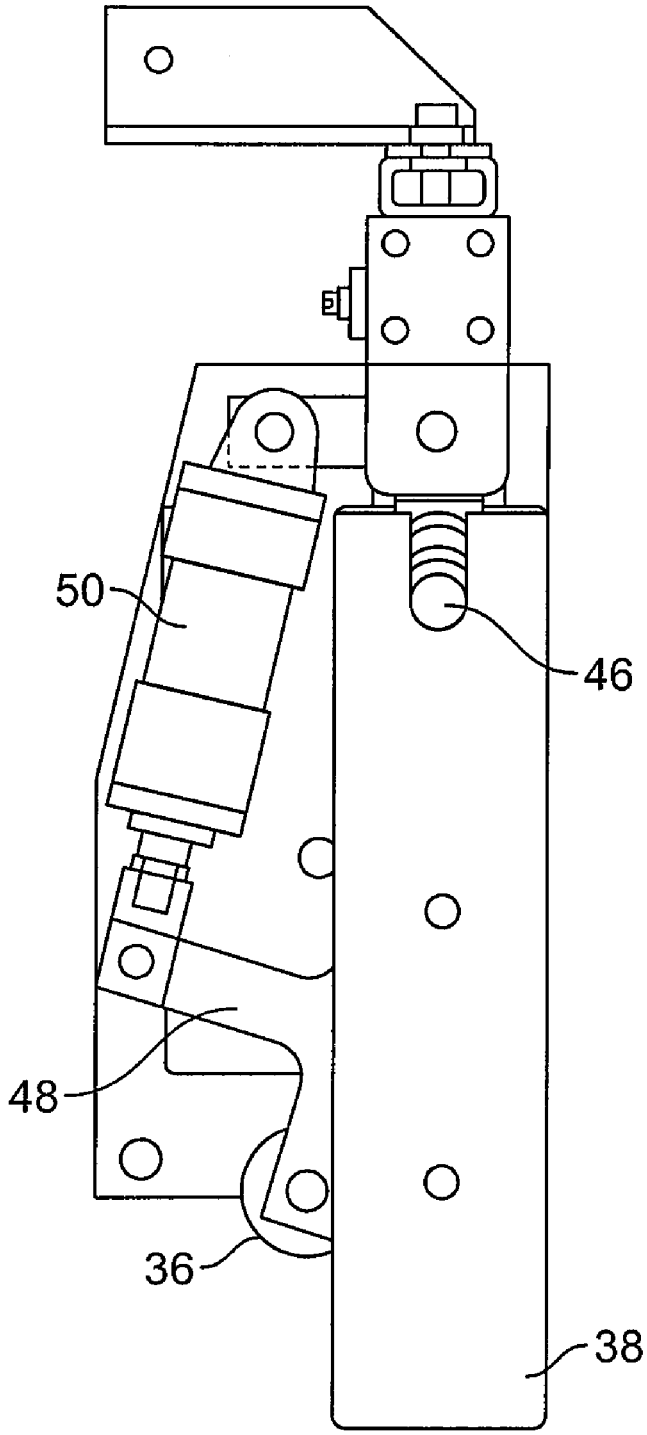
FIG. 4 is a side view of the a rotating assembly.
Figure 6:
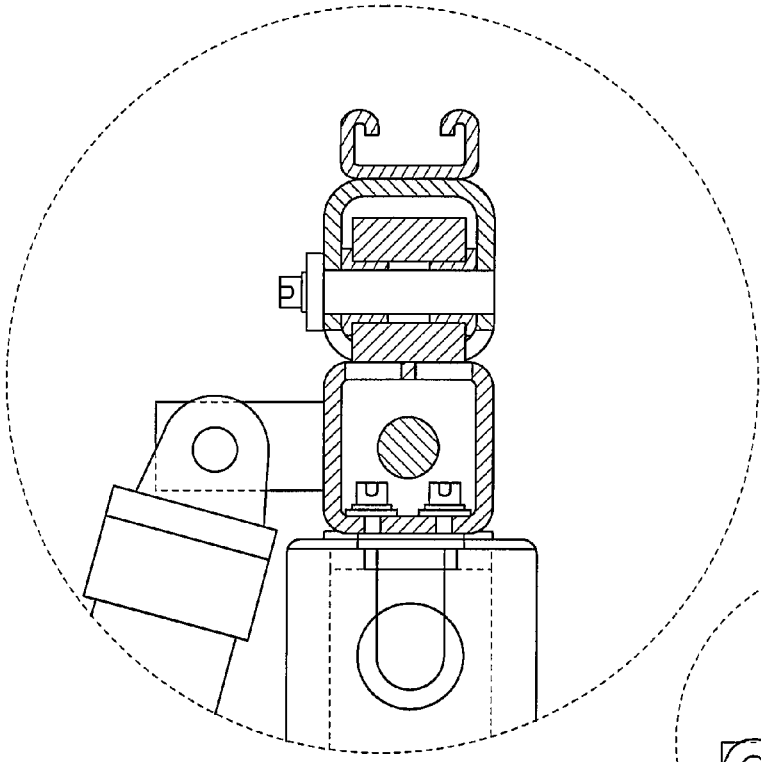
FIG. 6 is still another side view of the assembly.

Referring to the figures and in particular to FIG. 1A there is shown schematically, a strapping machine 10 having a strap joint rotator 12 in accordance with the principles of the present invention. FIG. 2 is a front view of the machine 10 and shows, generally, six separate but interdependent strapping units 14*a-f*. Each unit 14 includes a feed head 16 (to feed and retract the strap material S), a sealing head 18, portions of a side leg 20 of the strap chute, a lower portion 22 of the strap chute, an opposite side leg 29 of the strap chute and portions of a transition 24 to an upper portion 26 of the strap chute. Also shown is an upper compression plate or platen 28 (in phantom lines) that compresses the load L for strapping. The upper platen 28 includes the upper portion 26 of the strap chute. Also illustrated (for purposes of understanding), in phantom lines, is a bale of strapped material, indicated at a L. It will be understood that although the component of each of the units 14 are presented in singular, the present machine includes six of each of these components, each associated with one of the strapping units 14.

The strap rotator or strap joint rotator is illustrated generally at 12. The joint rotator 12 includes a rotating assembly 30 associated with each strapping unit 14. The rotator 12 includes a common drive 32, such as the illustrated motor for driving all of the assemblies 30*a-f*.

Each assembly 30 includes a driven wheel 34 and a pinch wheel 36. The driven wheel 34 is mounted to a side of a post or mount 38 and includes an inner flange 40 to appropriately position the strap S relative to the wheel 34. The drive 32 is operably connected to each of the driven wheels 34 to rotate the wheels 34. In a present assembly, the motor 32 drives a chain 42 that is engaged (by a gear 44) with a common drive shaft 46. The shaft 46 can drive each of the wheels 34 by gears and shafts, indicated generally at 47, to drive each of the wheels 34. Alternately, chains, belts, gears and the like can be used.

The pinch wheels 36 are each mounted to an arm 48 to move between an engaged position in which the pinch wheel 36 is engaged (or in contact) with the driven wheel 34 and a disengaged position in which the pinch wheel 36 is disengaged from (or out of contact with) the driven wheel 34.

Figure 7:
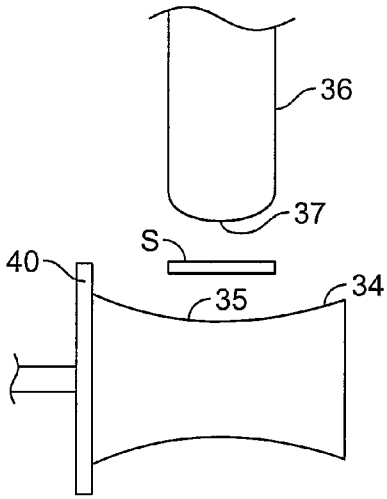
FIG. 7 is a schematic illustration of the driven and pinch wheels with a section of strap therebetween.
Figure 5:
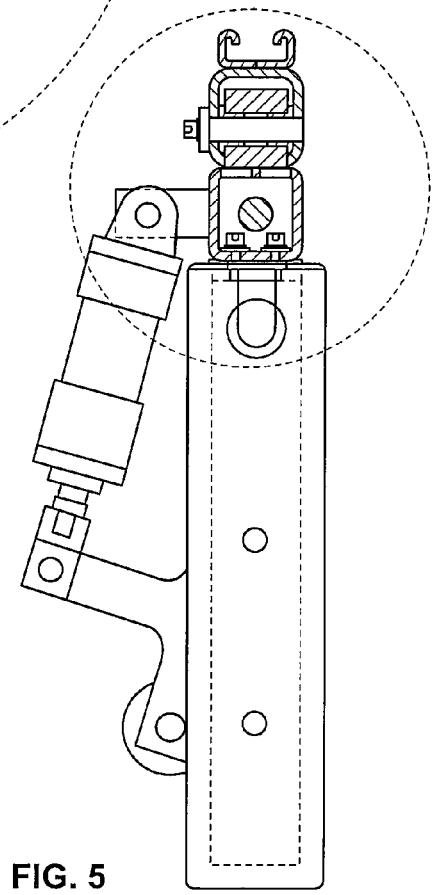
FIG. 5 is another side view of the assembly.

In a present rotator 12, the pinch wheel arm 48 is moved between the engaged and disengaged position by a cylinder 50 associated with the arm 48. The cylinder 50 can be a pneumatic, electro-mechanical or like cylinder that is mounted to the arm 48 to pivot the arm 48 between the engaged and disengaged positions of the pinch wheel 36. In a present configuration, the post 38 includes a stop 52 to prevent over-pivoting or over-rotation of the pinch wheel arm 48 relative to the driven wheel 34 and post 38. Referring briefly to FIG. 7, the driven wheel 34 has a concave profile (as indicated at 35) and the pinch wheel has a convex or crowned profile (as indicated at 37) to maintain the strap S properly aligned between the wheels 34, 36.

The assemblies 30 are mounted to the strapping machine 10 by a carriage 54 that is mounted to a beam 56 that is in turn mounted to the strapping machine 10. The beam 56 is fixedly mounted to the strapping machine 10, and the carriage 54 is mounted on rollers 58 for lateral movement along the beam 56. Movement of the carriage 54 along the beam 56 can be provided by a cylinder or like drive 60. The carriage 54 is laterally moveable to, as will be discussed in more detail below, move each of the assemblies 30, as one, into and out of a respective strap path P around the load L. In this movement, the driven and pinch wheels 34, 36 are moved into and out of the path P of the strap S (as it is looped) around the load L.

It will be appreciated that when the assemblies 30 are positioned in the strap path P, and the strap S is positioned around the load L, the strap S is also positioned over the driven 34 wheel (that is, the driven wheel 34 is captured within the strap loop O). As the drive 36 is actuated and the driven wheel 34 rotates, the pinch wheel 36 is engaged with the driven 34 wheel (and the strap S), which in turn drives the strap S. This rotates the strap S around the load L to, as desired, relocate the strap joint J to any desired location around the load L. When the desired location is reached, the drive 32 stops, the pinch wheel 36 disengages from the driven wheel 34, and the carriage 54 shifts to move the assemblies 30 out of their respective strap paths P.

In a typical operation, the load L to be bundled is introduced into the strapper 10. In the case of layers of compressible material, e.g., cotton or textile materials, with the flat side of the load L resting on the bottom or lower leg 22 of the strapper 10 and the layers built or piled upward, along the side leg 20 of the strap chute. The compression plate 28 (which has the top leg portion 26 of the strap chute formed therein) moves down and compresses the load L.

The strapping cycle then begins and strap S is fed from a supply Y to the feed head 16 through the strapping head 18, into the upper portion of the near side leg 20 of the chute and into the top leg 26 of the chute. The strap S travels across the top leg 26, then down the far leg 29 of the chute, along the bottom leg 22 and up the lower near leg portion 20, back to the strapping head 18.

The strapping cycle continues with the free or leading end of the strap material being gripped in the strapping head 18 and the feed system reversing to retract the strap S. The strap S is pulled from the strap chute onto the load L, is retracted, and sealed to itself. At this time, the rotator assemblies 30 are inserted into the strap loop O (into the strap path P), such that the strap S is positioned between the driven and pinch wheels 34, 36 (see FIG. 7). The strapping head 18 then opens to release the strap S.

With the strap S positioned over the driven wheel 34, the pinch wheel 36 moves into engagement with the driven wheel 34 and the strapping head 18 opens to release the strap S. The drive 32 is actuated to rotate the strap S (seal J), for example, to move the seal J from a side of the load L to the bottom of the load L. When the strap S has been rotated a desired distance, the (drive 32) driven wheel 34 stops and the pinch wheel 36 pivots out of engagement with the driven wheel 34. The carriage 54 is then shifted laterally to move the assemblies 30 out of their respective strap paths P and the top compression platen 28 is released. This allows the load L to expand against the retention of the strap S.

The opposite side legs 29 of the strapper 10 are also opened (moved away from the machine 10, as by pivoting, to open the strapping machine 10) and the load L is removed from the machine 10.

It will be appreciated that moving the seal J provides a number of advantages. For example, the largest stresses on the strap S will be exerted along the sides of the load L—in the direction of expansion of the load L. Accordingly, by rotating the strap S, the seal J is moved from a location of high stress to a location of lower relative stress. Moreover, the load L is often handled and transported with the load L on its side. As such, positioning the seal J at the top or bottom of the load L reduces the likelihood that the seal J will contact the floor or possibly become caught on the floor surface or a load stacked on top of or under the instant load L.

It will also be appreciated that although the present strap joint rotator 12 is shown and described as part of a strapper 10 for a compressible load L, the rotator 12 can be used with most any other type of strapping machine, including a strapping machine having modular components such as that disclosed in Flaum et al., U.S. Pat. No. 6,584,892, and its related patents, which patents are commonly assigned with the present application and are incorporated herein by reference.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A strap joint rotating assembly for use with a strapping machine of the type for feeding a strapping material around a load, positioning, tensioning and sealing the strapping material around the load, the strapping machine having a feed head for feeding the strapping material into strapping machine, a strap chute through which the strapping material is passed and a sealing head to seal overlapping courses of the strapping material onto itself to define a strap loop having a seal and defining a strap loop plane, the strap traversing from the feed head, through the strap chute and sealing head to define a strap path, the strap joint rotating assembly, comprising:

a driven wheel having an axis of rotation generally perpendicular to the sealed strap loop;

a first drive operably connected to the driven wheel for rotating the driven wheel;

a pinch wheel having an upper platen for compressing the load, an axis of rotation parallel to and spaced from the driven wheel, the driven wheel and the pinch wheel moveable toward one another and engageable with one another and moveable away from and disengaged from one another; and a second drive operably connected to the driven wheel and the pinch wheel for moving the driven wheel and the pinch wheel parallel to their axes of rotation into the strap loop plane and out of the strap loop plane, wherein the driven wheel and the pinch wheel are moved into the strap loop plane, the driven wheel and the pinch wheel are engaged with one another to pinch the strap therebetween and the driven wheel is actuated to rotate the strap loop around the load and to reposition the seal around the load.

2. The strap joint rotating assembly in accordance with claim 1 wherein the driven wheel is mounted to a post and wherein the pinch wheel is mounted to an arm that is mounted to the post, the arm being movable toward and away from the post.

3. The strap joint rotating assembly in accordance with claim 2 wherein the arm is pivotally mounted to the post.

4. The strap joint rotating assembly in accordance with claim 2 including a cylinder operably connected to the pinch wheel to move the pinch wheel toward and away from the post.

5. The strap joint rotating assembly in accordance with claim 1 wherein the driven wheel includes an outwardly extending flange at an edge of the driven wheel.

6. The strap joint rotating assembly in accordance with claim 1 wherein the driven wheel and the pinch wheel have complementary concave and convex profiles.

7. The strap joint rotating assembly in accordance with claim 6 wherein the driven wheel has a concave profile and the pinch wheel has a convex profile.

8. A strapping machine of the type for concurrently feeding multiple straps around a load, positioning, tensioning and sealing the straps around the load to define respective strap loop planes, a plurality of strap loops being sealed at respective seals, and rotating the straps around the load to reposition the respective seals, comprising:

a frame;

an upper platen for compressing the load;

a plurality of side-by-side strap chutes;

a plurality of feed systems each for feeding strap material into their respective strap chutes;

a plurality of sealing heads each for receiving their respective strap material, and sealing the strapping material to itself in overlaying courses to define respective strap seals; and a strap joint rotator including a plurality of strap joint rotating assemblies, the assemblies mounted to a carriage that is mounted to the frame, each of the assemblies including a driven wheel having an axis of rotation generally perpendicular to the sealed strap loop and a pinch wheel having an axis of rotation parallel to and spaced from the driven wheel, the driven wheel and pinch wheel moveable toward one another and engageable with one another and moveable away from and disengaged from one another, the strap joint rotator including a first drive operably connected to each of the driven wheels for rotating the driven wheels and a second drive operably connected to the carriage for moving carriage to move the assemblies, as one, into and out of their respective strap loop planes, wherein the driven wheels and pinch wheels are moved into their respective strap loop planes, the driven wheels and pinch wheels are engaged with one another to pinch their respective straps therebetween and the driven wheels are actuated, as one, to rotate their respective strap loops to reposition their respective seals around the load.

9. The strapping machine in accordance with claim 8 wherein the driven wheels are each mounted to a respective post and wherein the pinch wheels are each mounted to a respective arm that is mounted to their respective mounts, the arms being movable toward and away from their posts.

10. The strapping machine in accordance with claim 9 wherein the arms are pivotally mounted to their posts.

11. The strapping machine in accordance with claim 8 including a cylinder operably connected to each of the pinch wheels to move the pinch wheels toward and away from their respective posts.

12. The strapping machine in accordance with claim 8 wherein each of the driven wheels includes an outwardly extending flange at an edge of the driven wheel.

13. The strapping machine in accordance with claim 8 including a shaft operably connecting a common drive to each of the driven wheels.

14. The strapping machine in accordance with claim 8 wherein the second drive is a cylinder.

15. The strapping machine in accordance with claim 8 wherein the driven wheel and the pinch wheel have complementary concave and convex profiles.

16. The strapping machine in accordance with claim 15 wherein the driven wheel has a concave profile and the pinch wheel has a convex profile.

* * * * *

UNITED STATES PATENT AND TRADEMARK OFFICE

CERTIFICATE OF CORRECTION

PATENT NO. : 7,389,723 B1
APPLICATION NO. : 11/782120
DATED : June 24, 2008
INVENTOR(S) : Robert E. Bullington It is certified that error appears in the above-identified patent and that said Letters Patent is hereby corrected as shown below:

Col. 5 Claim 1, lines 3-5 should read, --load, positioning, tensioning and sealing the strapping material around the load, the strapping machine having an upper platen for compressing the load, a feed head for feeding the strapping material into the strapping machine, a--

Claim 1, lines 16-17 should read, --a pinch wheel having an axis of rotation parallel to and spaced from the--

Signed and Sealed this

Second Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,389,723 B1
APPLICATION NO. : 11/782120
DATED : June 24, 2008
INVENTOR(S) : Robert E. Bullington It is certified that error appears in the above-identified patent and that said Letters Patent is hereby corrected as shown below:

Col. 5 Claim 1, lines 20-22 should read, --load, positioning, tensioning and sealing the strapping material around the load, the strapping machine having an upper platen for compressing the load, a feed head for feeding the strapping material into the strapping machine, a--

Col. 5, Claim 1, lines 33-34 should read, --a pinch wheel having an axis of rotation parallel to and spaced from the--

This certificate supersedes the Certificate of Correction issued September 2, 2008.

Signed and Sealed this

Thirtieth Day of September, 2008

JON W. DUDAS
*Director of the United States Patent and Trademark Office*